United States Patent [19]

Demuth

[11] 3,991,793

[45] Nov. 16, 1976

[54] ECCENTRIC DRIVE FOR A DOBBY

[75] Inventor: Hans Demuth, Winterthur, Switzerland

[73] Assignee: Sulzer Brothers Limited, Winterthur, Switzerland

[22] Filed: Aug. 11, 1975

[21] Appl. No.: 603,386

[30] Foreign Application Priority Data

Aug. 12, 1974 Switzerland ..... 10998/74

[52] U.S. Cl. ..... 139/79

[51] Int. Cl.[2] ..... D03C 5/00

[58] Field of Search ..... 139/79–81, 139/55–57, 66, 88, 84; 74/512

[56] References Cited

UNITED STATES PATENTS

| | | | |
|---|---|---|---|
| 1,312,751 | 8/1919 | Rhoades | 139/79 |
| 2,437,349 | 3/1948 | Cobb | 139/79 |
| 2,592,820 | 4/1952 | Moessinger | 139/79 X |
| 3,587,660 | 6/1971 | Dion | 139/84 X |
| 3,741,257 | 6/1973 | Kleiner et al. | 139/66 R |

FOREIGN PATENTS OR APPLICATIONS

| | | | |
|---|---|---|---|
| 1,175,641 | 11/1958 | France | 139/57 |
| 450,687 | 7/1949 | Italy | 139/79 |
| 272,166 | 9/1970 | U.S.S.R. | 139/80 |
| 220,874 | 9/1968 | U.S.S.R. | 139/79 |

*Primary Examiner*—James Kee Chi

*Attorney, Agent, or Firm*—Kenyon & Kenyon Reilly Carr & Chapin

[57] ABSTRACT

The eccentric drive for moving the heddle frames between a top shed position and a bottom shed position is constructed to form symmetrical sheds not only for large frame movements but also for small frame movements. In one embodiment, the link between the cam-actuated lever and the deflecting lever is pivoted on the deflecting lever and secured to one of a plurality of positions on the cam-actuated lever. These positions are located on a curved line which has a center of curvature located away from the axis on which the link is mounted on the deflecting lever. These positions are formed by a toothing, a row of apertures or an elongated slot.

9 Claims, 5 Drawing Figures

ECCENTRIC DRIVE FOR A DOBBY

This invention relates to an eccentric drive for a dobby, and more particularly, a dobby for a weaving machine.

Heretofore, various eccentric mechanisms have been used in dobbys to drive the shafts, i.e. heddle carrying frames such as described in U.S. Pat. No. 3,696,842, of a weaving machine. Generally, such mechanisms use a plurality of eccentrics, cooperating cam follower levers and deflecting levers to drive frame actuating linkages secured to the frames. In addition, the deflecting levers are usually rotatably mounted on a spindle so as to rock back and forth while driving the frame actuating linkages. Usually, a link has been connected between a cam follower lever and a deflecting lever to transmit motion therebetween. Further, one end of this link has been pivotally connected to the deflecting lever while the opposite end is adjustably mounted on the cam-actuated lever to pivot therewith. The adjustment of the link on the cam-actuated lever allows the operative movement of a heddle frame to be adjusted. As a rule, the link is movable relative to the cam-actuated lever along a curved line which has a center of curvature coincident with the pivot axis of the link on the deflecting lever.

In this known device, when the operative movement of a frame is adjusted by movement of the link along the curved adjustment line, the bottom-shed position of the frame always remains the same. However, while the shed is symmetrical — i.e., the top-shed position and the bottom-shed position are both at the same distance from the center plane — for long operative movements of the frames; the shed becomes asymmetrical when the operative movements of the shafts are short, the top-shed position being too near the center-plane. Weaving may therefore become difficult or even impossible. It may also be impossible to use the short-movement range of the shafts.

Accordingly, it is an object of the invention to provide a dobby which is able to form a symmetrical shed for large and small heddle frame movements.

It is another object of the invention to form symmetrical sheds in a weaving machine in a simple manner.

It is another object of the invention to form symmetrical sheds in a weaving machine using substantially standard parts with slight modification.

Briefly, the invention provides a weaving machine having a plurality of heddle carrying frames with an eccentric drive for moving the frames between a top shed position and a bottom shed position. The eccentric drive comprises at least one frame actuating linkage, a double-arm deflecting lever which is pivotally mounted via a spindle and connected at one end to the frame actuating linkage, a pivotally mounted lever which pivots in a rocking manner under the influence of a pair of eccentrics and a link which connects the cam-actuated lever to the deflecting lever. The link has one end pivotally mounted on one of the deflecting lever and pivotally mounted lever about a pivot axis while the opposite end is secured to the other of the levers at one of a plurality of points on a curved adjusting line. This line has a center of curvature located away from the pivot axis of the link. The curved adjusting line is thus positioned to deviate from a circular arc having a center of curvature coincident with the pivot axis when the drive is in a bottom-shed position.

The curved adjusting line can be shaped, for example to impart a higher bottom-shed position at short frame movements, so that a symmetrical shed can be achieved or approximated. Alternatively, a constant bottom-shed position can be provided at long frame movements. In this latter case, the complete range of frame adjustment can be better utilized and advantageous weaving conditions can be provided for every operative movement of the frames.

These and other objects of the invention will become more apparent from the following detailed description taken in conjunction with the accompanying drawings in which:

FIG. 1 schematically illustrates a drive for a heddle frame in accordance with the invention;

Figure 1:
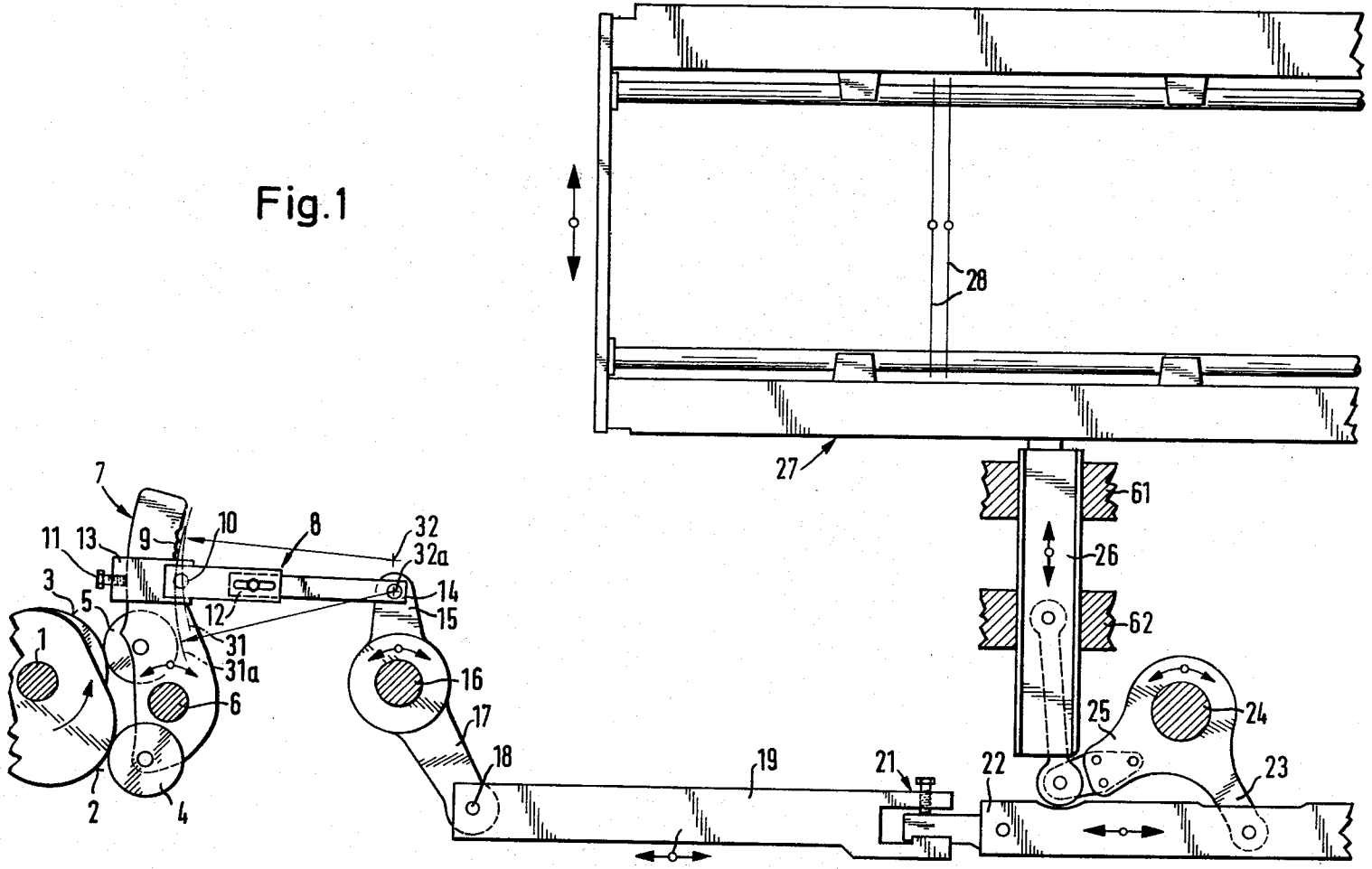

Referring to FIG. 1, a weaving machine of known construction has a plurality of heddle carrying frames such as described in U.S. Pat. No. 3,696,842 which are driven via an eccentric dobby. This dobby includes a shaft 1 which is driven off the main shaft of the associated weaving machine and carries a number of eccentrics, only two 2, 3, of which are shown. The eccentrics 2, 3 form an associated pair cooperating with rollers or cam-followers 4, 5 of a cam-actuated lever 7 which is mounted for pivoting around a spindle 6. Each lever 7 is pivotally connected by way of an adjustable link 8 to one arm 15 of a double-arm deflecting lever 15, 17 which is pivotally mounted via a spindle 16. The other arm 17 of each lever is connected at a place 18 to a shaft actuating linkage comprising a guide rod 19, a rod 22 connected to the guide rod 19 by a hook connection 21, a bell crank lever 23, 24 pivotably mounted via a pivot 24, and a vertical bar 26. The bar 26 functions as a lifter and is connected to a heddle frame 27 which carries warp heddles 28 for guiding warp yarns (not shown) for the shedding motions during weaving. As shown, the bar 26 is movable in guides 61, 62 to reciprocate vertically. The movement of the frame 27 and the other components 26, 23, 25, 22 are limited by the nearby elements of the dobby, for example, by the guide 61 or the rod 22, or other parts (not shown).

Figure 2:
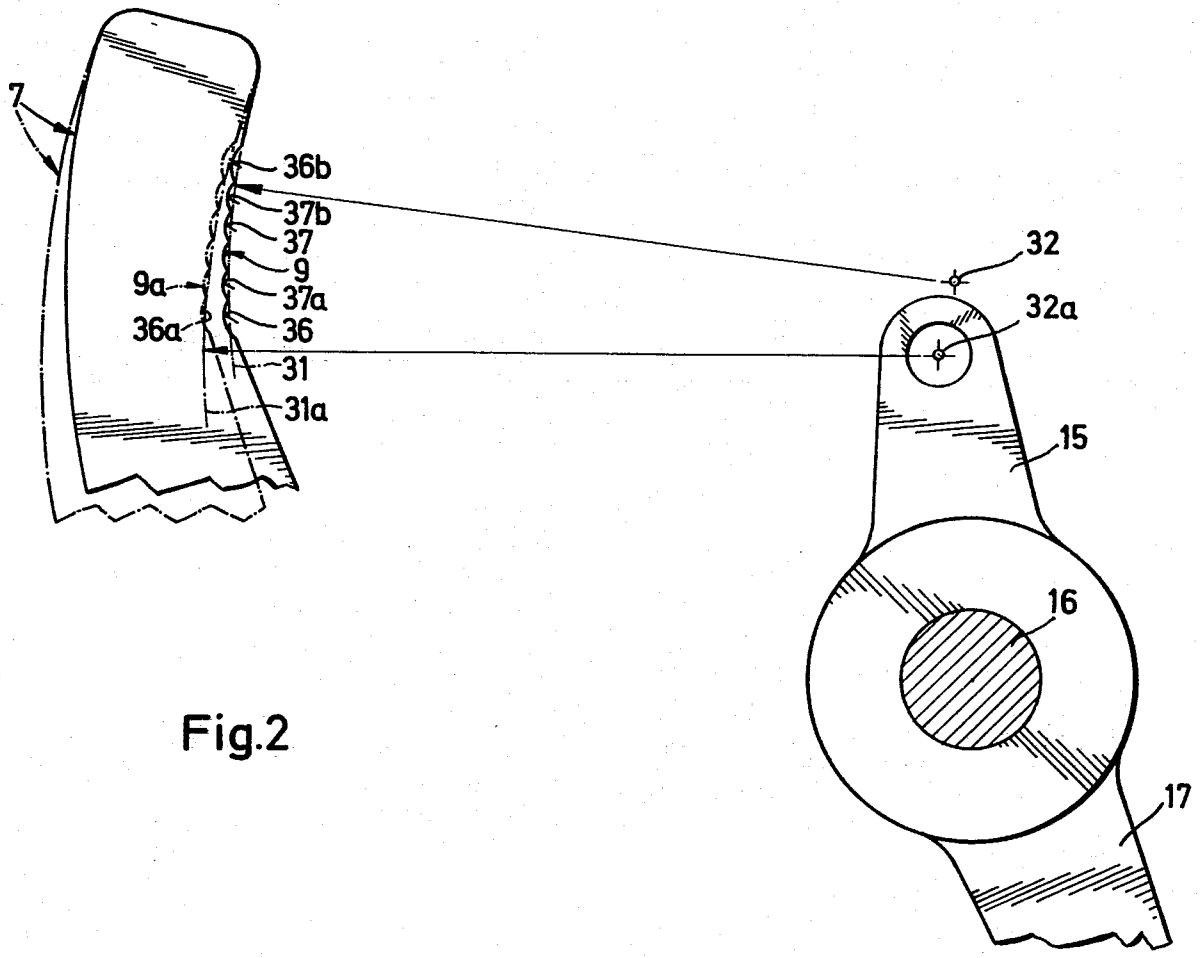
FIG. 2 illustrates an enlarged view of the relationship between a cam-actuated lever and a deflecting lever according to the invention.

The link 8 is pivotally connected at one end 14 to the deflecting lever 15, 17 about a pivot axis 32*a* while the opposite rider-like end 13 is secured to the cam-actuated lever 7 by an adjusting means formed by a pin 10 and screw 11. As shown in FIGS. 1 and 2, the lever 7 is formed with a toothing 9 which defines a plurality of recesses, for example six recesses 36, 37*a*, 37, 37*b*, 36*b*. The toothing 9 defines a curved adjusting line 31 having a center of curvature 32 located away from the pivot axis 32*a* of the link 8. The pin 10 fits into one of the recesses of the toothing 9 while the screw 11 serves to secure the link 8 in place upon tightening.

The link 8 is also provided with a means 12 for adjusting the length of the link 8.

By way of comparison, FIG. 2 shows the toothing 9*a* of a known dobby, wherein the toothing extends along a curved adjustment line 31*a* which is also arcuate, but has a center of curvature at the pivot axis 32*a* where end 14 of link 8 is pivoted to the arm 15 of the double arm deflecting lever 15, 17.

Figure 5:
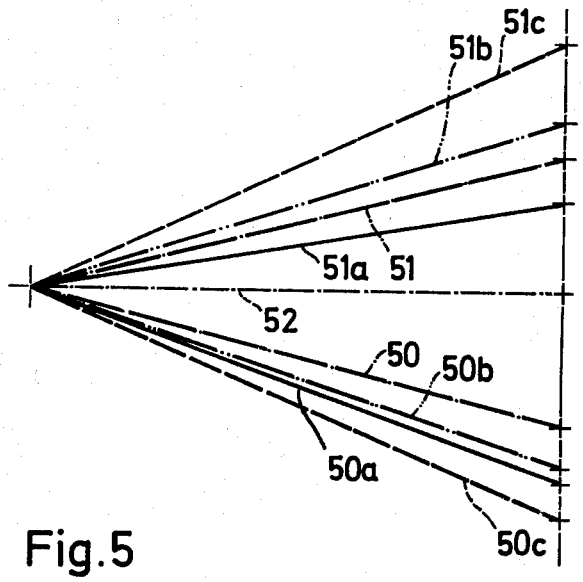
FIG. 5 graphically illustrates various shed positions.

FIGS. 1 and 2 show the parts in the highest bottom-shed position, obtainable with the link 8 pivoted in the bottom recess 36 of the toothing line 31. In this position, the lever 15, 17 has pivoted further clockwise than for the same setting in the recess 36*a* of the line 31*a*. Consequently, the bottom-shed position 50 which is shown in chain-dotted lines in FIG. 5 and which is associated with the line 31 is higher than the bottom-shed position 50*a* which is shown in solid lines and which is associated with the line 31*a*. Correspondingly, the top-shed position 51 associated with the adjustment line 31 is higher than the top-shed position 51*a* associated with the line 31*a*. The higher positioning in the dobby results in the sheds 50, 51 being symmetrical of the shed center-plane 52, whereas the sheds 50*a*, 51*a* of the known dobby are assymetrical.

When the pin 10 is moved into the central recess 37 of the toothing 9 for example to lengthen frame movement i.e., when the link 8 is adjusted upwards in FIG. 1, the lever 15, 17 pivots further counter-clockwise, since the circle center 32 does not coincide with the pivot axis 32*a*. Thus, the new bottom-shed position 50*b* of the frame 27 is lower than the former bottom-shed position 50. The associated top shed position has the reference 51*b*. The new shed 50*b*, 51*b* is also substantially symmetrical.

When the link 8 is placed in the top recess 36*b* to give maximum frame movement, the lowest bottom-shed position 50*c* (FIG. 5) and the highest top-shed position 51*c* occur. As shown, the position 51*c* is higher than for a corresponding symmetrical shed, that is, a non-symmetrical shed is formed.

Since the center of curvature 32 is above the pivot axis 32*a* as shown in FIGS. 1 and 2, the bottom-shed position remains substantially constant for adjustments in the range of relatively long frame movements corresponding to the recesses 37*b*, 36*b* of the toothing 9. On the other hand, for adjustments in the short frame movement range corresponding to the recess 37*a* there is a relatively considerable shift in the bottom-shed position; for instance, when there is a reduction of movement in the small-movement range 37*a*, the bottom-shed position experiences a considerable upwards shift.

It may be convenient in some cases to shape the curved adjustment line 31 so that in the small-movement range 37*a*, the shed remains substantially symmetrical despite frame movement adjustments whereas in the long-movement range 37*b*, the top-shed position is lower than for a symmetrical shed. Increased warp tension, which may also be desirable, can then be achieved in the bottom shed (baggy warp = weaving in which the warp yarns in the top shed position are looped around the weft yarns more than are the warp yarns in the bottom shed position).

Figure 3:
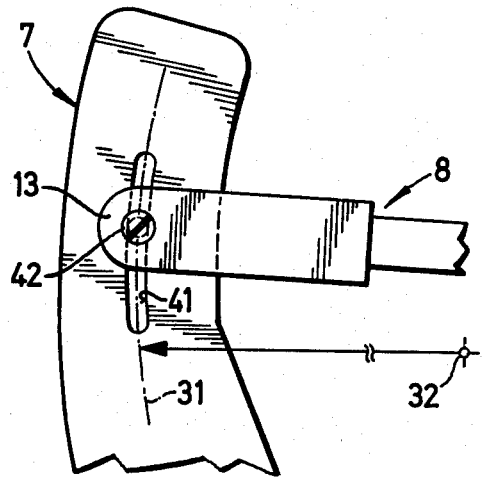
FIG. 3 illustrates a modified cam-actuated lever having a slot defining the curved adjusting line in accordance with the invention.
Figure 4:
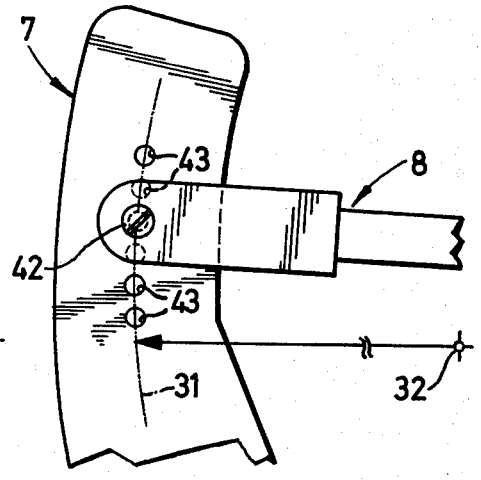
FIG. 4 illustrates a modified cam-actuated lever having a row of apertures defining the curved adjusting line in accordance with the invention.

Referring to FIG. 3, instead of forming the curved adjusting line 31 by a lever or cam follower 7, the line 31 may be formed by a slot 41 in which an adjusting screw 42 in the link 8 is guided steplessly. Also, as shown in FIG. 4, the adjusting line 31 may also be defined by a row of discrete apertures 43 in which the link 8 can be engaged stepwise through the agency of an element 42 such as a pin or a screw.

The toothing 9, slot 41 and apertures 43 serve to adjust the actual operative movement of the frames, but adjustment of the length of the link 8 by means of the adjustment means allows raising or lowering of the complete frame movement.

The curved adjusting line 31 can be of some other form, for instance, other than circular or elliptical or of irregular curvature, in the manner which best corresponds to frame movement and frame movement adjustment requirements and which deals very satisfactorily with the problem of available space, which is limited by the nearby parts of the dobby. However, in the bottom-shed position of the frame 27 and the levers, the adjusting line 31 must always differ from the arc 31*a* with the center of curvature 32*a*.

The curved adjusting line 31 or the toothing 9 can also be formed on the arm 15 of the deflecting lever 15, 17 while the pivot axis 32*a* is disposed on the lever 7. Also, the toothing 9 can be omitted from the embodiment shown in FIG. 1, in which event, the link 8 is pivotally connected in steplessly variable manner just by the rider-like end 13 being clamped to any part of the lever 7 by means of the screw 11. The link length adjusting means 12 can be omitted. Further, the levers and the linkages between the drive represented by the eccentrics 2, 3 and the frame 27 can differ from that shown in FIG. 1.

Also, the invention is capable of use not only for eccentric dobbies but for other kinds of dobby, e.g. for jacquard dobbies.

What is claimed is:

1. An eccentric drive for driving a heddle carrying frame in a weaving machine, said drive comprising at least one frame actuating linkage;

a spindle;

a double-armed deflecting lever pivotally mounted on said spindle and connected at one end to said frame actuating linkage to reciprocate said linkage in response to pivoting of said lever;

a pivotally mounted lever; and a link having one end pivotally mounted on one of said deflecting lever and said pivotally mounted lever about a pivot axis and having an opposite end secured to the other of said deflecting lever and said pivotally mounted lever at one of a plurality of points on a curved adjusting line, said line having a center of curvature located away from said pivot axis whereby said line deviates from a circular arc having a center of curvature coincident with said pivot axis when said drive is in a bottom-shed position.

2. An eccentric drive as set forth in claim 1 wherein the lowest of such points in said curved adjusting line effects a short operative movement of said frame actuating linkage whereby a bottom-shed position of an actuated frame is higher than a bottom-shed position associated with a corresponding position of said circular arc.

3. An eccentric drive as set forth in claim 1 wherein the lowest of said points in said curved adjusting line effects a symmetrical shed.

4. An eccentric drive as set forth in claim 1 wherein the highest of said points in said curved adjusting line effects a substantially constant bottom-shed position.

5. An eccentric drive as set forth in claim 1 wherein said link is pivotally mounted on said deflecting lever and said pivotally mounted lever includes a toothing along said curved adjusting line defining a plurality of recesses and which further comprises a pin secured in said link and disposed in one of said recesses of said toothing.

6. An eccentric drive as set forth in claim 1 wherein said other of said deflecting lever and said pivotally mounted lever has a slot defining said curved adjusting line and said link carries an adjusting screw mounted in said slot.

7. An eccentric drive as set forth in claim 1 wherein said other of said deflecting lever and said pivotally mounted lever has a row of apertures defining said curved adjusting line and said link carries an adjusting screw mounted in one of said slots.

8. An eccentric drive as set forth in claim 1 wherein said link has a means for adjusting the length thereof.

9. In a dobby having a plurality of heddle carrying frames, an eccentric drive for moving said frames between a top-shed position and a bottom-shed position, said drive including at least one frame actuating linkage;

a spindle;

a double-armed deflecting lever pivotally mounted on said spindle and connected at one end to said frame actuating linkage to reciprocate said linkage in response to pivoting of said lever;

a pivotally mounted lever; and a link having one end pivotally mounted on one of said deflecting lever and said pivotally mounted lever about a pivot axis and having an opposite end secured to the other of said deflecting lever and said pivotally mounted lever at one of a plurality of points on a curved adjusting line, said line having a center of curvature located away from said pivot axis whereby said line deviates from a circular arc having a center of curvature coincident with said pivot axis when said drive is in a bottom-shed position.

* * * * *